US007175461B1

(12) United States Patent
Ju

(10) Patent No.: US 7,175,461 B1
(45) Date of Patent: Feb. 13, 2007

(54) SELF-POSITIONING AND LIMITING APPARATUS AND AN ELECTRICAL CONNECTOR USING THE SAME

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/375,339

(22) Filed: Mar. 15, 2006

(51) Int. Cl.
*H01R 13/62* (2006.01)

(52) U.S. Cl. ..... 439/326; 439/159; 439/328

(58) Field of Classification Search ..... 439/630, 439/159, 941, 326, 328
See application file for complete search history.

(56) References Cited

U.S. PATENT DOCUMENTS 5,839,913 A * 11/1998 Fumikura ..... 439/326
6,030,245 A * 2/2000 Choy ..... 439/328
6,164,998 A * 12/2000 Poi et al. ..... 439/326
6,743,028 B2 * 6/2004 Wang ..... 439/92
6,817,875 B2 * 11/2004 Chang et al. ..... 439/159
6,908,322 B1 * 6/2005 Bricaud et al. ..... 439/152
6,939,156 B2 * 9/2005 Lee ..... 439/328

FOREIGN PATENT DOCUMENTS

CN 98214208.0 7/1999

* cited by examiner

*Primary Examiner*—Michael C. Zarroli
(74) *Attorney, Agent, or Firm*—Rosenberg, Klein & Lee

(57) ABSTRACT

A self-positioning and limiting apparatus includes a fixing part, a moving part, and a push-stop part located between the fixing part and the moving part so as to prevent the moving part from being moved excessively. An electrical connector having the self-positioning and limiting apparatus includes an insulating body and conducting pins. A central plugging slot is located on the insulating body along a lengthwise direction. A pair of locking devices are located at the two opposite ends of the insulating body and each of locking devices includes a self positioning and limiting apparatus. The self-positioning and limiting apparatus includes a fixing part, a moving part, and a push-stop part located between the fixing part and the moving part.

10 Claims, 6 Drawing Sheets

SELF-POSITIONING AND LIMITING APPARATUS AND AN ELECTRICAL CONNECTOR USING THE SAME

BACKGROUND OF THE INVENTION

1. Field of the Invention

The present invention relates to a self-positioning and limiting apparatus and an electrical connector using the same.

2. Description of the Related Art

Currently, electrical connectors used for connecting a memory module to a circuit board generally include a positioning and limiting apparatus. Such an electrical connector includes an insulating body having an elongated shape. A central plugging slot is located on the insulating body and is used for receiving the memory module. A plurality of conducting pins are located at the two sides of the central plugging slot for connecting the memory module mechanically and electrically. A pair of locking devices are located at the two opposite ends of the insulating body. Each locking device includes a locking part (also called a plastic piece) and an unlocking part (also called a metal piece, having a positioning and limiting apparatus). The plastic piece extends forward from the two ends of the insulating body, and cooperates with the locking devices to make the memory module firmly connected with the connector. Therefore, the memory module is electrically connected with the circuit board. China patent CN2329095Y discloses an electrical connector having a locking device. The unlocking part includes a first stop-moving body and a first push-stop piece for limiting the displacement of the unlocking part. However, the structure of the locking device is complex. The manufacturing process is difficult.

SUMMARY OF THE INVENTION

One particular aspect of the present invention is to provide a self-positioning and limiting apparatus and an electrical connector using the same. The structure is simple and the manufacturing process is easy.

The self-positioning and limiting apparatus includes a fixing part, a moving part, and a push-stop part located between the fixing part and the moving part so as to prevent the moving part from being moved excessively.

The electrical connector having the self-positioning and limiting apparatus includes an insulating body and conducting pins. A central plugging slot is located on the insulating body in a lengthwise direction. A pair of locking devices are located at the two opposite ends of the insulating body. Each locking device includes a self positioning and limiting thin flattened area. The self-positioning and limiting apparatus includes a fixing part, a moving part, and a push-stop part located between the fixing part and the moving part so as to prevent the moving part from being moved excessively.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
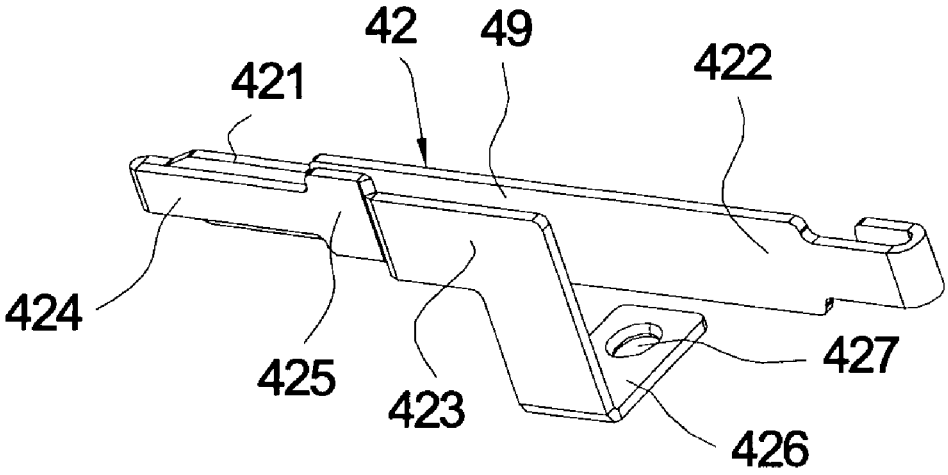
FIG. 1 is a perspective view of the self-positioning and limiting apparatus of the present invention.
Figure 2:
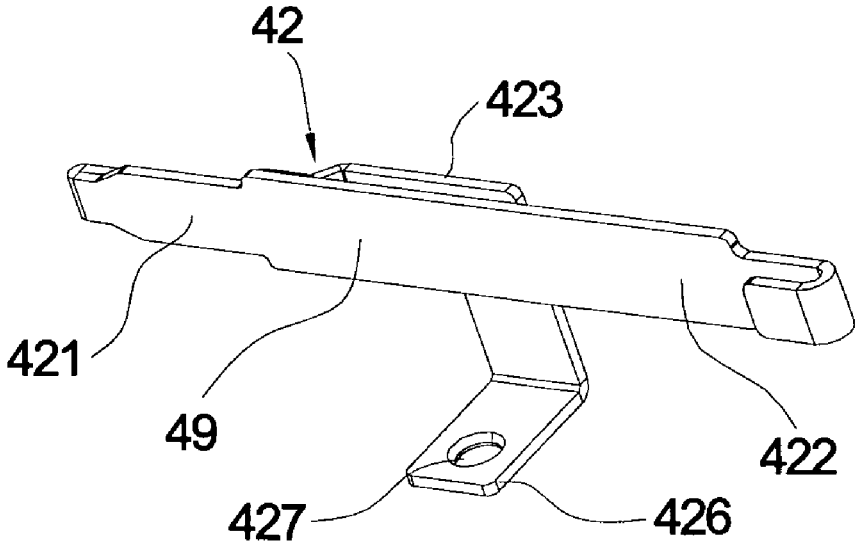
FIG. 2 is another perspective view of the self-positioning and limiting apparatus of FIG. 1.
Figure 3:
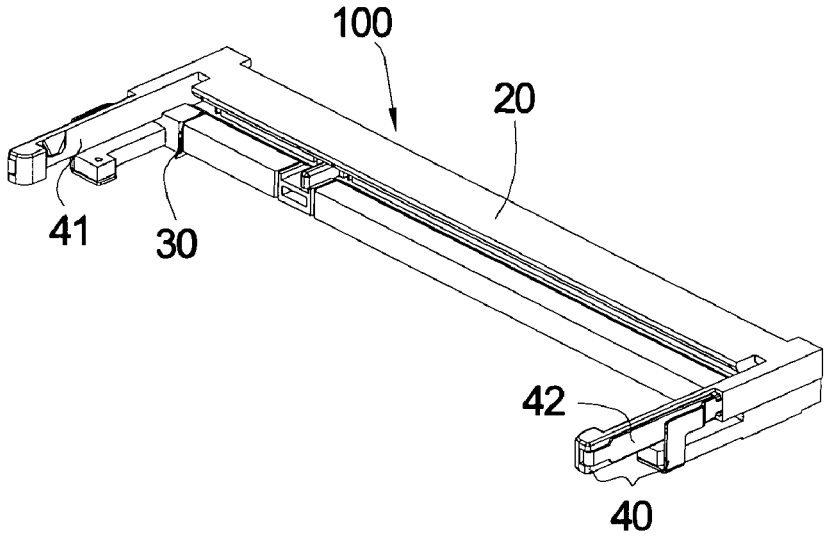
FIG. 3 is an assembly perspective view of the electrical connector of the present invention.
Figure 4:
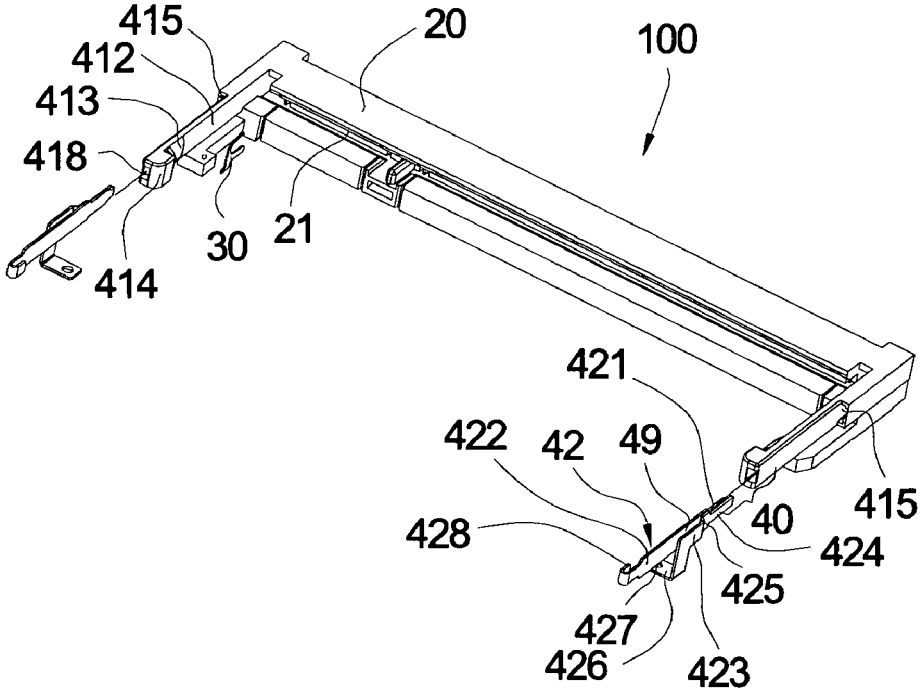
FIG. 4 is an exploded perspective view of the electrical connector of FIG. 3.
Figure 5:
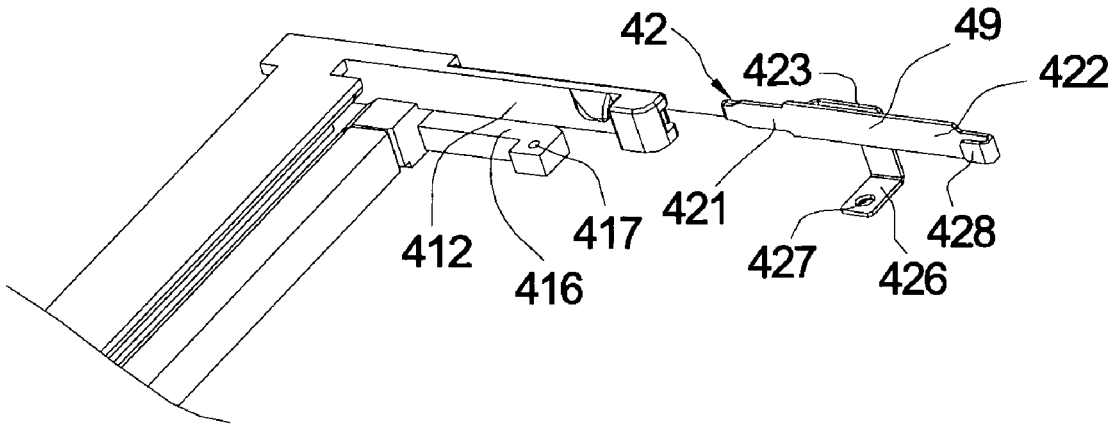
FIG. 5 is an amplifying view of part of the electrical connector of FIG. 4.

The detailed illustration of the self-positioning and limiting apparatus and an electrical connector using the same of the present invention is described below.

Please refer to FIGS. 1 to 5. The self-positioning and limiting apparatus 42 of the present invention is used in the electrical connector 100 supporting the memory module (not shown in the figure). The self-positioning and limiting apparatus 42 includes a fixing part 421, and a moving part 422. The fixing part 421 fastens the self-positioning and limiting apparatus 42 into the electrical connector 100. The self-positioning and limiting apparatus 42 further includes a thin flattened area 49, and the moving part 422 is located at an end of the thin flattened area 49. The moving part 422 is used for unlocking the memory module supported in the electrical connector 100. A push-stop part 423 is located between the fixing part 421 and the moving part 422. The push-stop part 423 is extended by bending. The push-stop part 423 is used for preventing the moving part 422 from being moved excessively.

The electrical connector 100 having the self-positioning and limiting apparatus includes an insulating body 20 having an elongated shape and a central plugging slot 21 located on the insulating body 20 in an lengthwise direction. A plurality of conducting pins 30 (only one is displayed in the figure) are located at the two sides of the central plugging slot 21 for connecting with the memory module mechanically and electrically. A pair of locking devices 40 are located at the two opposite ends of the insulating body 20. Each locking device 40 includes a plastic piece 41 and the self-positioning and limiting apparatus 42.

The plastic piece 41 is extended from the two ends of the insulating body 20, and a locking arm 412 is extended from the front end of the plastic piece 41. At the inner part of the end of the locking arm 412, a locking part 413 protrudes inward to fasten the memory module (an external card). Alternatively, the locking part 423 can also be located on the self-positioning and limiting apparatus 42. A wedging part 414 is adjacent to the locking part 413. A wedging slot 418 is located in the wedging part 414 and is concave. A slot 415 is located at the outside of the plastic piece 41 so that it matches the self-positioning and limiting apparatus 42. The plastic piece 41 has a welding arm 416 and the welding arm 416 leans on the locking arm 412. The welding arm 416 has a receiving hole 417.

At one end of the self-positioning and limiting apparatus, there is a fixing part 421, and a moving part 422 extended from an opposite side of the apparatus from the fixing part 421. The fixing part 421 is received in the slot 415 of the plastic piece 41. The self-positioning and limiting apparatus 42 further includes a thin flattened area 49. The thin flattened area 49 is positioned on an outside of the locking arm 412 of the plastic piece 41, and the moving part 422 is located at one end of the thin flattened area 49. The self-positioning and limiting apparatus 42 further comprises a wedging part 428 that is wedged in the wedging slot 418 of the plastic piece 41. A push-stop part 423 is located between the fixing part 421 and the moving part 422. The push-stop part 423 is formed by bending and is laterally spaced from the thin flattened area 49. The push-stop part 423 prevents the moving part 422 from being moved outward excessively. The push-stop 423 includes a connecting arm 424 formed by bending and extends outwardly therefrom. The connecting arm 424 is parallel to the fixing part 421 and also is received in the sot 415 of the plastic piece 41. A push-stop arm 425 is formed at the end of the connecting arm 424 so as to stop the moving part 422, and the push-stop arm 425 is connected with the push-stop part 423. A welding part 426 is extended downward from the push-stop part 423. The welding part 426 is orthogonal to the push-stop part 423. On the welding part 426, there is a through hole 427. The welding part 426 leans on the welding arm 416 of the plastic piece 41. The through hole 427 of the welding part 426 corresponds to the receiving hole 417 of the welding arm 416. There is a welding material (not shown in the figure) in the receiving hole 417 so as to make the welding part 426 weld with the circuit board.

Figure 6:
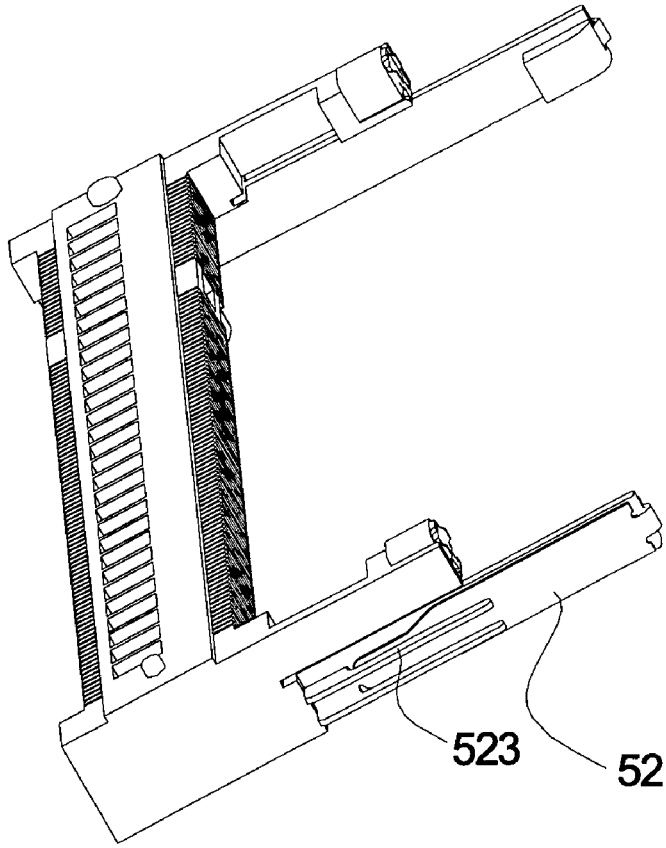
FIG. 6 is an assembly perspective view of the electrical connector of the second embodiment of the present invention.
Figure 7:
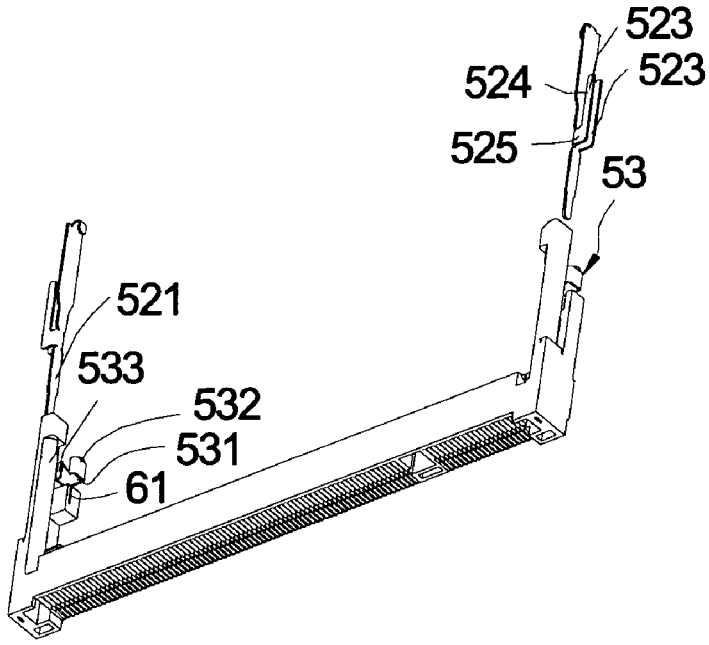
FIG. 7 is an exploded perspective view of the electrical connector of FIG. 6.
Figure 8:
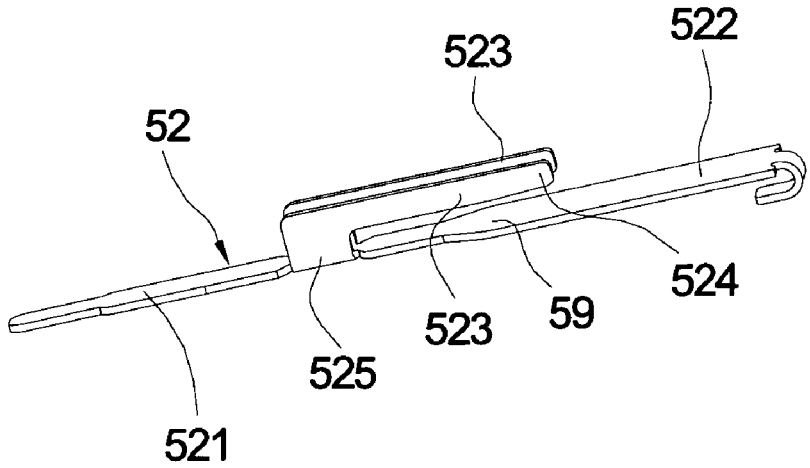
FIG. 8 is a perspective view of the metal flake of the second embodiment of the present invention.

Please refer to FIGS. 6~8, which show the self-positioning and limiting apparatus and the electrical connector using the same of the second embodiment of the present invention. The self-positioning and limiting apparatus 52 also includes a thin flattened area 59. The difference between the present embodiment and the previous one is that the push-stop part 523 is formed by bending the thin flattened area 59 from the two sides of the thin flattened area 59. Alternatively, the push-stop part 523 can be formed by bending the thin flattened area 59 from only one side of the thin flattened area 59. For this embodiment, in which the push-stop part 523 is formed by bending the thin flattened area 59 from the two sides of the thin flattened area 59, the push-stop part 523 restricts the displacement more effectively when the moving part 522 is moved outward. The force is normally distributed across the push-stop part 523 and it is difficult to make the push-stop part 523 deform. This is a preferred embodiment. The push-stop part 523 has a push-stop arm 524 for stopping the moving part 522 and a connecting arm 525 for connecting the thin flattened area 59 to the push-stop arm 524. The electrical connector further includes a welding piece 53 that is installed in the insulating body. The welding piece 53 includes a body 531 and a fixing block 532 that is bent and extended from the two sides of the body 531. At the end of the fixing block 532, there is a bent wedging part 533. There is a wedging slot 61 on the insulating body that matches the wedging part 533. The height of the wedging slot 61 is greater than the height of the wedging part 533, and there is a gap between the welding piece 53 and the insulating body 531 so as to make the welding piece 53 to move in the insulating body in upward and downward directions. Then, a welding material (not shown in the figure) is used for welding the welding part 53 with a circuit board (not shown in the figure). The structure of the self-positioning and limiting apparatus is simple. The manufacturing process is easy and the manufacturing cost is low.

Figure 9:
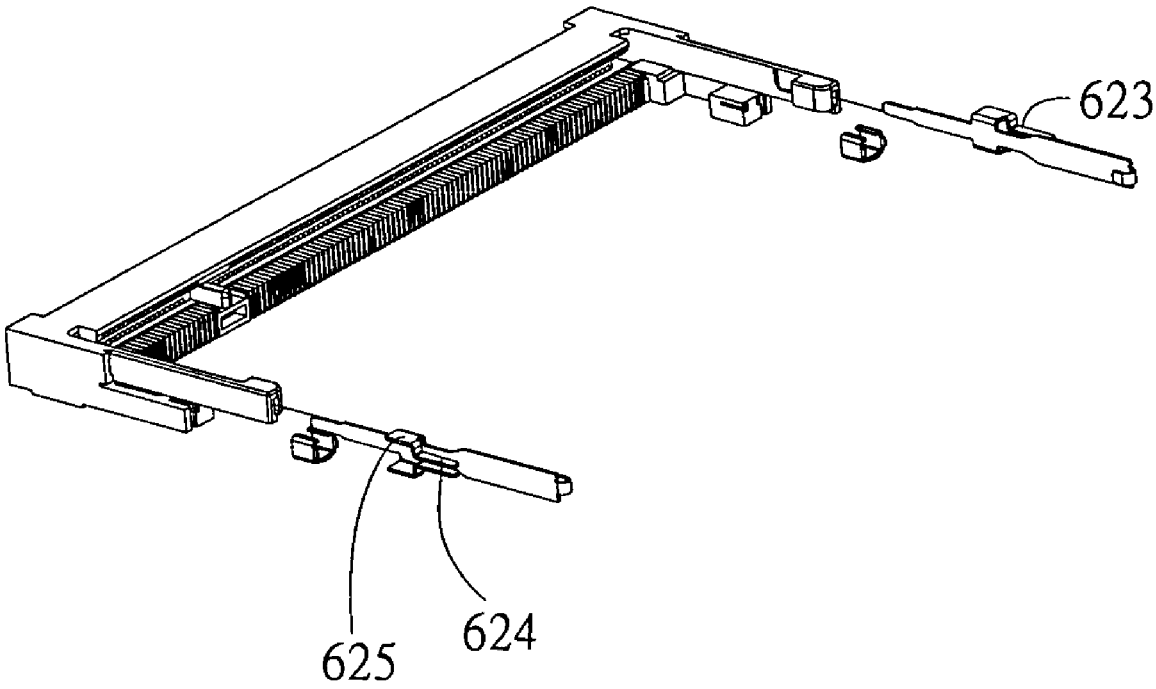
FIG. 9 is an exploded perspective view of the electrical connector of the third embodiment of the present invention.

Please refer to FIG. 9, which shows the self-positioning and limiting apparatus and the electrical connector using the same of the third embodiment of the present invention. The difference between the present embodiment and the second one is that the push-stop part 523 includes a connecting arm 625 and a push-stop arm 624 formed by bending and then extending the connecting arm.

Figure 10:
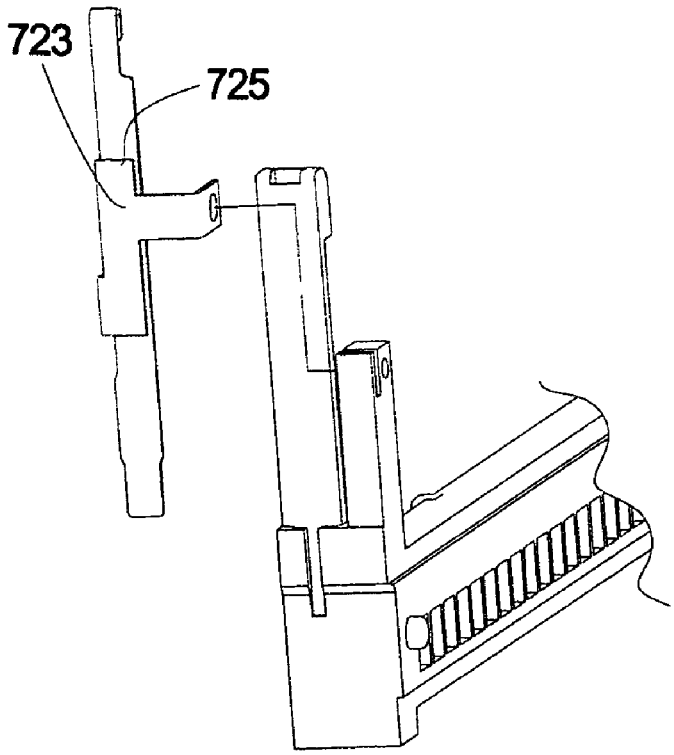
FIG. 10 is an exploded perspective view of part of the electrical connector of the fourth embodiment of the present invention.
Figure 11:
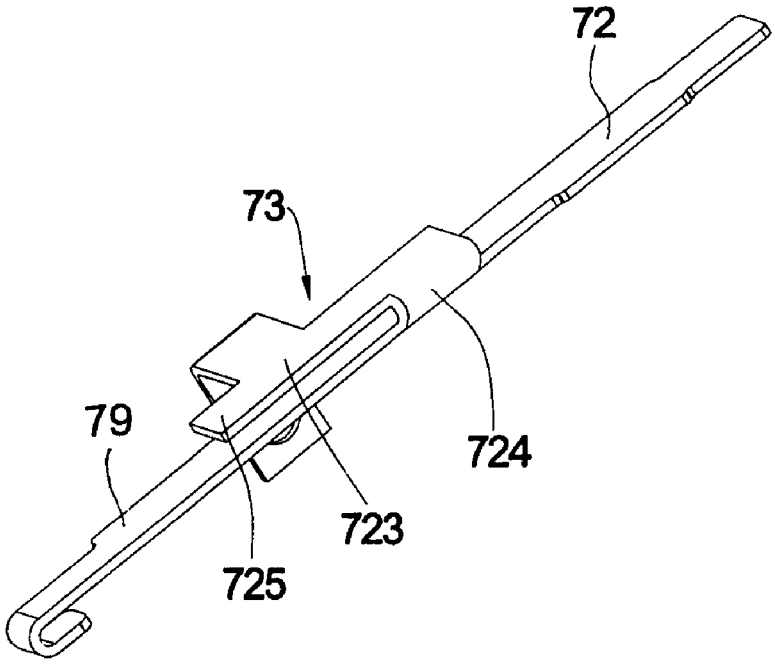
FIG. 11 is a perspective view of the metal flake of the fourth embodiment of the present invention.

Please refer to FIGS. 10 and 11, which show the self-positioning and limiting apparatus and the electrical connector using the same of the fourth embodiment of the present invention. The self-positioning and limiting apparatus 73 also includes a thin flattened area 79. The difference between the present embodiment and the first embodiment is that the push-stop part 723 is formed by bending the thin flattened area 79 from one side of the thin flattened area 79. The push-stop part 723 includes a connecting arm 724 that is bent and extended and a push-stop arm 725 that is formed by bending one end of the connecting arm 724 and extending. The structure of the self-positioning and limiting apparatus is simple. The manufacturing process is easy and the manufacturing efficiency is enhanced.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A self-positioning and limiting apparatus for use in an electrical connector, comprising:

a fixing part extending longitudinally in a first direction;

a moving part coupled to the fixing part and extending longitudinally in a second direction, the second direction being opposite the first direction;

a connecting arm extending from a distal end of the fixing part in the second direction; and a push-stop part coupled to the connecting arm and being aligned with an area disposed between the fixing part and the moving part in spaced side-by-side relationship to prevent the moving part from being moved excessively in the electrical connector.

2. The self-positioning and limiting apparatus as claimed in claim 1, further comprising a flattened area disposed between the fixing part and the moving part.

3. The self-positioning and limiting apparatus as claimed in claim 2, wherein the push-stop part has a welding part extending orthogonally therefrom, the welding part having a through hole formed therein for coupling to a circuit board.

4. The self-positioning and limiting apparatus as claimed in claim 2, wherein the push-stop part is coupled to the connecting arm by a push-stop arm extending therebetween, the push-stop arm being bent with an offset to laterally space the push-stop part from the flattened area.

5. A self-positioning and limiting apparatus for use in an electrical connector, comprising:

a longitudinally extended flattened area;

a fixing part extending longitudinally from the flattened area in a first direction;

a moving part extending longitudinally from the flattened area in a second direction, the second direction being opposite the first direction; and a push-stop part formed by bending one side of the flattened area, the push-stop part including (a) a connecting arm extending transversely from the flattened area, (b) a push-stop arm extending longitudinally from an end of the connecting parts, and (c) a welding part extending orthogonally from the push-stop arm for coupling to a circuit board.

6. An electrical connector, comprising:

an insulating body having a plugging slot formed therein and a pair of welding arms extending from two opposite ends thereof for coupling of the insulating body to a circuit board;

a plurality of conducting pins disposed in the plugging slot; and a pair of locking devices respectively located at the two opposite ends of the insulating body adjacent to the pair of welding arms, each of the locking devices including a self-positioning and limiting apparatus engaged with a locking arm formed at a respective end of the insulating body, each locking arm having a first wedging part located adjacent a distal end thereof and a wedging slot formed through the distal end, each locking arm having a slotted opening disposed adjacent a proximal end thereof, the self-positioning and limiting apparatus including (a) a longitudinally extended flattened area, (b) a fixing part extending longitudinally from the flattened area in a first direction to be received within the slotted opening, (c) a moving part extending longitudinally from the flattened area in a second direction, the second direction being opposite the first direction, the moving part having a second wedging part formed at an end thereof engaged in the wedging slot, (d) a push-stop part located in spaced aligned relationship with the flattened area between the fixing part and the moving part, and (e) a welding part coupled to the push-stop part and extending beneath a corresponding welding arm for coupling therewith to the circuit board.

7. The electrical connector as claimed in claim 6, wherein the push-stop part is coupled to an end of the fixing part by a connecting arm and a push-stop arm extending therebetween.

8. The electrical connector as claimed in claim 7, wherein the push-stop arm is bent with an offset to laterally space the push-stop part from the flattened area.

9. The electrical connector as claimed in claim 6, wherein the push-stop part is coupled to one side of the flattened area, the push-stop part including a connecting arm extending transversely from the flattened area, and a push-stop arm extending longitudinally from an end of the connecting part.

10. The electrical connector as claimed in claim 6, wherein each locking arm includes a locking part extending inwardly for engagement with an external card received in the electrical connector.

* * * * *